US008116980B2

(12) United States Patent
Beretta et al.

(10) Patent No.: US 8,116,980 B2
(45) Date of Patent: Feb. 14, 2012

(54) TESTING PROCESS FOR HYDROCARBON WELLS AT ZERO EMISSIONS

(75) Inventors: Enzo Beretta, Cremona (IT); Alessandro Tiani, Milan (IT); Gaetano Lo Presti, Caltanissetta (IT)

(73) Assignee: ENI S.p.A., Rome (IT)

( * ) Notice: Subject to any disclaimer, the term of this patent is extended or adjusted under 35 U.S.C. 154(b) by 605 days.

(21) Appl. No.: 12/301,329

(22) PCT Filed: May 11, 2007

(86) PCT No.: PCT/EP2007/004269

§ 371 (c)(1),
(2), (4) Date: Dec. 10, 2008

(87) PCT Pub. No.: WO2007/134747

PCT Pub. Date: Nov. 29, 2007

(65) Prior Publication Data

US 2009/0114010 A1 May 7, 2009

(30) Foreign Application Priority Data

May 19, 2006 (IT) ..... MI2006A0995

(51) Int. Cl.
*G01V 1/40* (2006.01)
*E21B 47/00* (2006.01)

(52) U.S. Cl. ..... 702/13; 73/152.39

(58) Field of Classification Search ..... 73/152.39, 73/152.41, 152.51; 702/13
See application file for complete search history.

(56) References Cited

U.S. PATENT DOCUMENTS 4,157,730 A 6/1979 Despois et al.
5,501,273 A 3/1996 Puri
2004/0049346 A1 3/2004 Despax et al.
2005/0222852 A1 10/2005 Craig

OTHER PUBLICATIONS

Beretta, E. et al., "Injection Tests as a Reliable Alternative to Conventional Well Testing: A Real Field Experience", SPE International 100283, pp. 1-12, XP002411021, (2006).
Gunawan, R. et al., "Application of Injection Tests for Reservoir Appraisals: A Conceptual Study", SPE International 77454, pp. 1-12, XP002411022, (2002).
Levitan, M. et al., "Application of Water Injection/Falloff Tests for Reservoir Appraisal: New Analytical Solution Method for Two-Phase Variable Rate Problems", SPE International 77532, pp. 1-11, XP002411023, (2002).
Whittle, T.M. et al., Will Wireline Formation Tests Replace Well Tests?, SPE International 84086, pp. 1-12, XP002411024, (2003).
Hachlaf, H. et al., Effect of Variable Injection Rate on Falloff and Injectivity Tests, SPE International 76714, pp. 1-9, XP002411025, (2002).

*Primary Examiner* — John Fitzgerald

(74) *Attorney, Agent, or Firm* — Oblon, Spivak, McClelland, Maier & Neustadt, L.L.P.

(57) ABSTRACT

Testing process for testing hydrocarbon wells at zero emissions in order to obtain general information on a reservoir. The process includes injecting into the reservoir a suitable liquid or gaseous fluid, compatible with the hydrocarbons of the reservoir and with the formation rock, at a constant flow-rate or with constant flow rate steps, and substantially measuring, in continuous, the flow-rate and injection pressure at the well bottom. Then, the well is closed and the pressure is measured during the fall-off period (pressure fall-off). The measured fall-off data is interpreted in order to evaluate the average static pressure of the fluids (Pav) and the reservoir properties including actual permeability (k), transmissivity (kh), areal heterogeneity or permeability barriers and real Skin factor (S). Then, well productivity is calculated.

6 Claims, 3 Drawing Sheets

TESTING PROCESS FOR HYDROCARBON WELLS AT ZERO EMISSIONS

FIELD OF DISCLOSURE

The present invention relates to a process for testing zero emission hydrocarbon wells with the aim of obtaining main information on the reservoir, analogously to traditional well testing, with no surface production of hydrocarbons.

BACKGROUND

Well testing is a fundamental instrument for the exploration and planning of hydrocarbon fields, as it is capable of offering a wide range of dynamic information on the reservoir-well system.

Furthermore, the data on the reservoir fluids which can be obtained through sampling during well testing are of great importance, particularly for explorative or appraisal wells.

Conventional well testing is a consolidated process in the oil industry, both from an operative and interpretative point of view.

The well is induced to supply from the level/reservoir to be tested. 2 or 3 drawdowns are normally effected, at increasing flow-rate steps. During each phase, the flow-rate of the hydrocarbons produced is maintained constant and measured at the separator. Following the supply phase, the well is closed (with a valve at the head or bottom of the well) and there is a pressure build-up.

Pressure and temperature measuring devices (P/T gauges) are used during the test, situated at the well bottom, generally slightly above the producing level. During a well test samples of the reservoir fluid are normally taken, both on the surface at the separator and at the well bottom with suitable sampling devices.

Conventional tests are effected in wells of the explorative/appraisal or development/production type, temporarily (DST string) or permanently completed.

In all cases in which the well is not connected to a surface line, once the hydrocarbons supplied during the production test have been separated at the surface, they must be suitably disposed of.

The hydrocarbons produced at the surface during the test are normally burnt at the torch. Carbon dioxide ($CO_2$) and sulphuric acid ($H_2S$), lethal for human beings even at very low concentrations (a few parts per million, ppm), can be associated with these. The presence of $H_2S$ in the hydrocarbons produced causes considerable safety problems during the test.

The oil produced can be stored in tanks (onshore or offshore), if there is the possibility of sending it to a nearby treatment center, or eliminating it with suitable burners. The gas is in any case burnt in the atmosphere. The volumes of hydrocarbons supplied during a well test can be important. The following table shows an example according to the type of hydrocarbon and test to be carried out:

| | Conventional test |
|---|---|
| Oil well | 100-1000 $m^3$<br>(Associated gas 100-1000 $m^3$ each $m^3$ of oil produced) |
| Gas well | $1\text{-}10 \cdot 10^6$ $m^3$ |

In addition to safety problems, there are also environmental problems due to the emission into the atmosphere of combusted hydrocarbons products and the risk of spilling in the sea or protected areas.

Environmental and safety problems are becoming increasingly more important, also as a result of environmental regulations which are more and more sensitive and restrictive as far as emissions into the atmosphere are concerned. Kazakhstan and Norway are among the countries in which present environmental regulations impose zero emissions.

Well testing allows a description of the unknown "reservoir+well" system. The principle is to stimulate the "reservoir+well" system by means of an input (flow-rate supplied) and measuring the response of the system as an output (bottom pressure). The pressure and flow-rate measurements provide an indirect characterization of the system, through known and consolidated analytical models found in literature.

The main objectives of conventional well testing are:

- sampling to define the reservoir fluids
- evaluation of the reference pressure of the fluids (Pav) and reservoir properties (actual average permeability k and transmissivity kh)
- quantification of the damage to the formation (Skin factor). This effect, due to both the local reduction in permeability around the well and to geometrical effects of the flow shape, is quantified by means of a non-dimensional number (Skin factor)
- evaluation of the well productivity (Productivity index PI for oil wells—Flow equation for gas well)
- evaluation of possible areal heterogeneity or permeability barriers.

SUMMARY

A process has been found which allows hydrocarbon wells to be tested without the necessity of producing surface hydrocarbons, thus avoiding relative environmental, safety and regulation problems, by the injection of a fluid into the well to be tested.

The injection of a fluid into a reservoir is already substantially used in the oil industry for other purposes: the injection test is normally carried out to evaluate the injectivity capacity of the formation. The injection normally occurs in the aquifer and in any case in wells destined for the injection and disposal of water. The quantities directly measured are the injectivity index of the formation and the transmittance (kh) in the aquifer.

The process developed for the execution and interpretation of injection tests is applied in hydrocarbon mineralised areas and, on the contrary, allows the characterization of the future behaviour of the level tested during the production phase.

The process, object of the present invention, for testing zero emission hydrocarbon wells to obtain general information on a reservoir, comprises the following steps:

- injecting a suitable liquid or gaseous fluid into the reservoir, compatible with the hydrocarbons of the reservoir and with the formation rock, at a constant flow-rate or constant flow-rate steps, and substantially measuring, in continuous, the flow-rate and injection pressure at the well bottom;
- closing the well and measuring the pressure and possibly the temperature, during the fall-off period;
- interpreting the fall-off data measured in order to evaluate the average static pressure of the fluids (Pav) and the reservoir properties: actual permeability (k), transmissivity (kh), areal heterogeneity or permeability barriers and actual Skin (S);
- calculating the well productivity.

DETAILED DESCRIPTION

Figure 1:
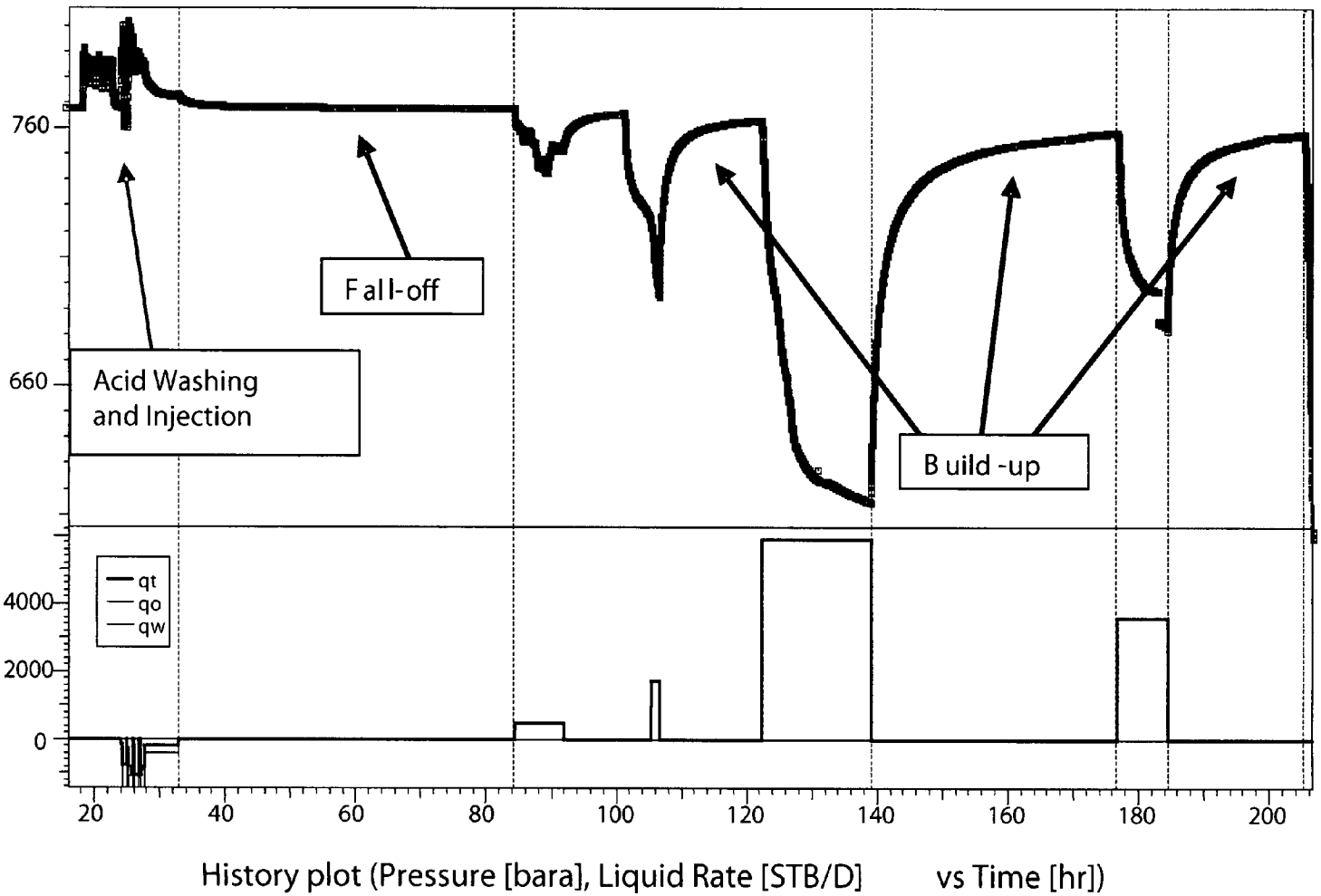
FIG. 1 is a history plot of pressure and liquid rate vs. time showing acid washing and injection, fall-off and build-up.

The steps forming the process according to the invention are now described in more detail.

The first two steps represent the $1^{st}$ phase (Phase A) (Execution of injection and pressure fall-off tests).

The objective of this phase is to acquire data relating to the bottom pressure (BHP Bottom Hole Pressure) during an injection period with a constant flow-rate and the subsequent pressure fall-off following the closing of the well.

The well is completed in a temporary (DST string) or permanent manner in the interval to be tested for oil or gas.

From the point of view of technology/materials to be used, there is no difference between conventional tests and injection tests. The lay-out of the surface equipment is further simplified.

The fluid to be injected, liquid or gaseous, must be selected for the purpose by means of laboratory tests, so as to be compatible with the hydrocarbons and the formation into which it will be injected. The formation of emulsions or precipitates following the interaction of the fluid to be injected with the fluid and/or the reservoir rock, should be avoided in particular.

The fluid to be injected is selected on the basis of the following criteria:

- Compatibility
- Inexpensiveness and availability
- Minimum differences of viscosity and compressibility under P,T reservoir conditions with the hydrocarbon to be removed.

For the compatibility studies, it is advisable to avail of a sample of dead oil of the reservoir fluid obtained either by means of a sampling or in other wells of the same reservoir.

The fluid to be injected is preferably liquid, selected from water or a hydrocarbon compound (i.e. diesel).

The injection is effected at a constant rate (or at constant rate steps). In order to increase the reliability of the data to be interpreted, it is advisable not to exceed fracture flow-rates, maintaining the injection under matrix conditions.

The closing of the well (at the head or at the bottom) and the measuring of the fall-off pressure follows the injection phase. When technically feasible, we suggest effecting the well closing at the bottom to limit the effects of storage and other disturbances which can influence the quality of the data acquired.

The duration of the injection period and subsequent fall-off are variable and defined according to the expected characteristics of the formation (kh, Φ, etc.) and specific objectives of the test. The duration of an injection/fall-off test are on the same scale as a conventional well test, i.e. preferably 1 hour to 4 days, more preferably 1 day to 2 days.

The criterion for defining the durations is fully analogous to the design of a conventional well test.

Sampling of the reservoir fluids is not possible through an injection test. When it is necessary to sample the fluids, resort must be made to other specific options for the sampling (ex. WFT sampling (Wireline Formation Test).

The remaining steps represent the $2^{nd}$ phase (Phase B) (Data interpretation).

The interpretation of the injection/fall-off data is aimed at achieving the main objectives of conventional well testing.

More specifically:

- Evaluation of the fluid reference pressure (Pav) and of the reservoir properties (actual average permeability k and transmissivity kh)
- Quantification of the damage to the formation, Skin Factor (S).
- Evaluation of the well productivity (Productivity Index PI for oil wells—Flow equation for gas wells)
- Evaluation of possible area heterogeneities or permeability barriers tested during the test period.

As already mentioned, sampling is not possible through an injection test.

The data interpretation is preferably effected as follows:

- Evaluation of Pav, kh and k: the interpretation is fully conventional on the fall-off data. It can be effected using any analytic well testing software available in industry or through the application of the consolidated equations of the well testing theory.

In particular, the following observations are made:

a. The pressure disturbance spreads in the virgin area of reservoirs, mineralised with hydrocarbons, once the limited area invaded by the injected fluid has been exceeded. The thermodynamic properties of the hydrocarbon (PVT data) must obviously be known.

b. The evaluation of (kh) oil/gas (and therefore of the k permeability, the net thickness h being known) is carried out at a time/investigation range higher than that of the bank of injected fluid generated around the well. The parameters obtained are therefore representative of the un-contaminated and mineralised hydrocarbon area.

- Skin Factor, S: through a conventional interpretation of the pressure fall-off, it is possible to evaluate a total Skin. This value includes, in addition to the Skin Factor (S) as in conventional well testing, a bi-phase Skin (S*) due to the interaction of the fluids in the reservoir (injected fluid/hydrocarbons).

The bi-phase Skin is not present in the future well production phase and must therefore be quantified and subtracted from the total Skin measured by means of the fall-off analysis.

Quantitative Evaluation of the Bi-Phase Skin (S*):

The bi-phase Skin can be evaluated in different ways described hereunder in decreasing order of reliability:

a. When the injection period is relatively long, so that the injected fluid bank is sufficiently extensive as to be identified with the log-log analysis, it is sufficient to use a conventional analytical model (of the radial composite type). In this case, the Skin relating to the first stabilization should be intended as the Skin Factor (S) from conventional well testing. The permeability of the injected fluid is deduced from the first stabilization. The subsequent second stabilization, on the contrary, represents the actual permeability of the hydrocarbon.

b. When the injection period is relatively short and only the second stabilization is detectable (hydrocarbon virgin area) the bi-phase Skin must be evaluated using a numerical well testing simulator which considers the fluid removal equations and the relative permeability curves. It is possible to reproduce the trend of the injection and fall-off pressures through the numerical simulator, establishing S=0. A conventional interpretation of the data generated by the simulator, produces a Skin value which proves to be the only bi-phase Skin (S*), S=0 having been established in the simulator.

c. In the absence of a numerical simulator, it is possible to evaluate, in a first approximation, the bi-phase Skin, with the formula of the Skin Factor from a radial composite:

$$S* = \frac{1 \cdot M}{M} \ln \frac{r_{interface}}{r_w}$$

wherein $$M = \frac{k_{r\ inj.max}(S_{or})}{\mu_{inj}} \Big/ \frac{k_{r\ HC.max}(S_{wi})}{\mu_{HC}}$$

is calculated once the fluid viscosity ($\mu_{inj}$ and $\mu_{HC}$) and the relative permeabilities (end points: $k_{r\ inj.max}$ and $k_{r\ HC.max}$) are known.

The interface radius can be evaluated in relation to the volume injected:

$$r_{interface} = \sqrt{\frac{V_{injected}}{\pi h \phi (1 - S_{or})} + r_w^2}$$

Evaluation of the Skin Factor (S) as in conventional well testing:

With the exception of the previous item a. wherein S is obtained directly, the Skin Factor (S) must be evaluated by subtracting the component S* from the total Skin, according to the Skin formula found in literature. In the simple case of the absence of geometrical Skin components, the formula to be used is:

$$S = (S_t - S^*)M$$

It is advisable to effect a test design with the numerical simulator to evaluate the minimum duration of the injection time and fall-off, which is such as to be able to identify, by means of log-log analysis, the stabilization relating to the bed of fluids. If it is technically and economically feasible, this type of test leads to the direct measurement of the Skin Factor Well productivity: the well productivity can be calculated through equations known in literature for the transient PI (oil well) or flow equation (for gas well).

For example, in the case of an oil well:

$$PI_{transient} = \frac{kh}{1626 \mu_o B_o \left[ \log \frac{kt}{\Phi \mu_o c_t r_w^2} - 3.23 + 0.87S \right]} \text{(oilfield unit)}$$

In the case of a gas well:

$$\Delta m(p) = A q_{SC} + B q_{SC}^2$$

$$\text{wherein } m(p) = 2 \int_{po}^{p} (p/zm) dp$$

$$A = \frac{711t}{kh} \left( \ln 2.246 \frac{kt}{\Phi \mu_g c_t r_w^2} + 2S \right)$$

$$B = \frac{711t}{kh} 2D$$

The parameters of these equations are all known. The coefficient D of the equation can be evaluated from literature.

Areal heterogeneities or permeability barriers: the interpretation occurs in a fully conventional manner on the fall-off data.

An example is now provided for a better illustration of the invention, which should not be considered as limiting the scope of the present invention.

EXAMPLE

In the following example, a short injection test followed by fall-off was effected, after acid washing. A conventional production test was subsequently effected at the same level (FIG. 1).

The bottom pressure and temperature and the production and injection flow-rates were monitored in continuous during all the operations.

The example shows the application of the procedure on the injection/fall-off test, which is compared with the results of the conventional test.

| Input data: | |
|---|---|
| Petrol-physical parameters: | |
| Porosity (Φ): | 0.08 |
| Net thickness (h): | 62.5 m |
| Well radius ($r_w$): | 0.108 m |
| Fluid characterization (PVT—Pressure Volume Temperature) | |
| Reservoir temperature T: | 98.5° C. |
| Reservoir pressure $P_{av}$: | 767 bar |
| Oil | Injected fluid: sea water |
| $B_o$: 2.40 RB/STB | $B_w$: 1 RB/STB |
| $\mu_o$: 0.24 cP | $\mu_w$: 0.32 cP |
| $c_o$: 18.0 × $10^{-5}$ $bar^{-1}$ | $c_w$: 4.30 × $10^{-5}$ $bar^{-1}$ |

The compressibility of the formation was estimated from standard correlations:

$$C_f: 7.93 \times 10^{-5}\ \text{bar}^{-1}$$

The total compressibility in an oil area ($S_w$=0. 1 and $S_o$=0.9) was calculated as being:

$$c_t = 24.6 \times 10^{-5}\ \text{bar}^{-1}$$

Build-Up and Fall-Off Analysis

Figure 2:
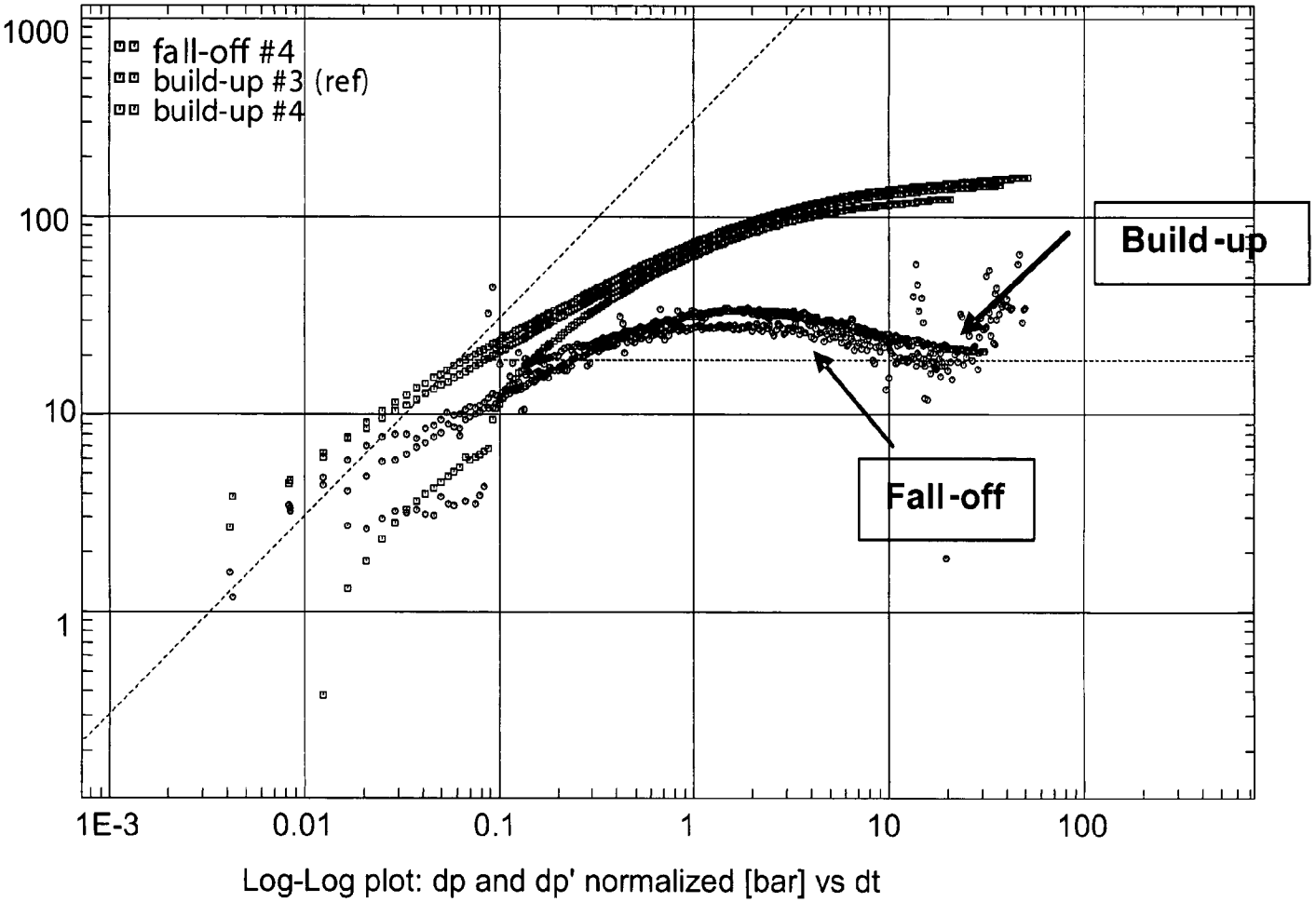
FIG. 2 is a Log-Log plot of build-up and fall-off derivatives.

The build-up and fall-off derivatives (Log-log graph) are shown in FIG. 2. The interpretation was effected with an infinite homogeneous model.

The following table (Tab. 1) compares the results obtained from the interpretation of the build-up and fall-off.

The negative skin values are due to the dissolution effects of the acid, effected on the carbonatic formation before the test.

TABLE 1

Main results of the fall-off and build-up interpretation

| | Build-up | Fall-off |
|---|---|---|
| Fm. pressure, bar | 767.1 | 767.1 |
| $P_{wf}$, bar | 614.5 | 772.6 |
| Flow rate, $m^3$/day | 940 | −65 |
| kh (oil zone), mDm | 230 | 230 |
| k average (oil), mD | 3.7 | 3.7 |

TABLE 1-continued

| Main results of the fall-off and build-up interpretation | | |
|---|---|---|
| | Build-up | Fall-off |
| Inv. radius, m | 125 | nd |
| Real Skin, S | −3.2 | nd |
| Total Skin, $S_t$ | nd | −3.3 |
| Duration, hr | 16.9 | 6.0 |
| PI, $m^3$/d/bar | 6.2 | nd |

Evaluation of the Bi-Phase Skin (S*) and Real Skin (S)

Figure 3:
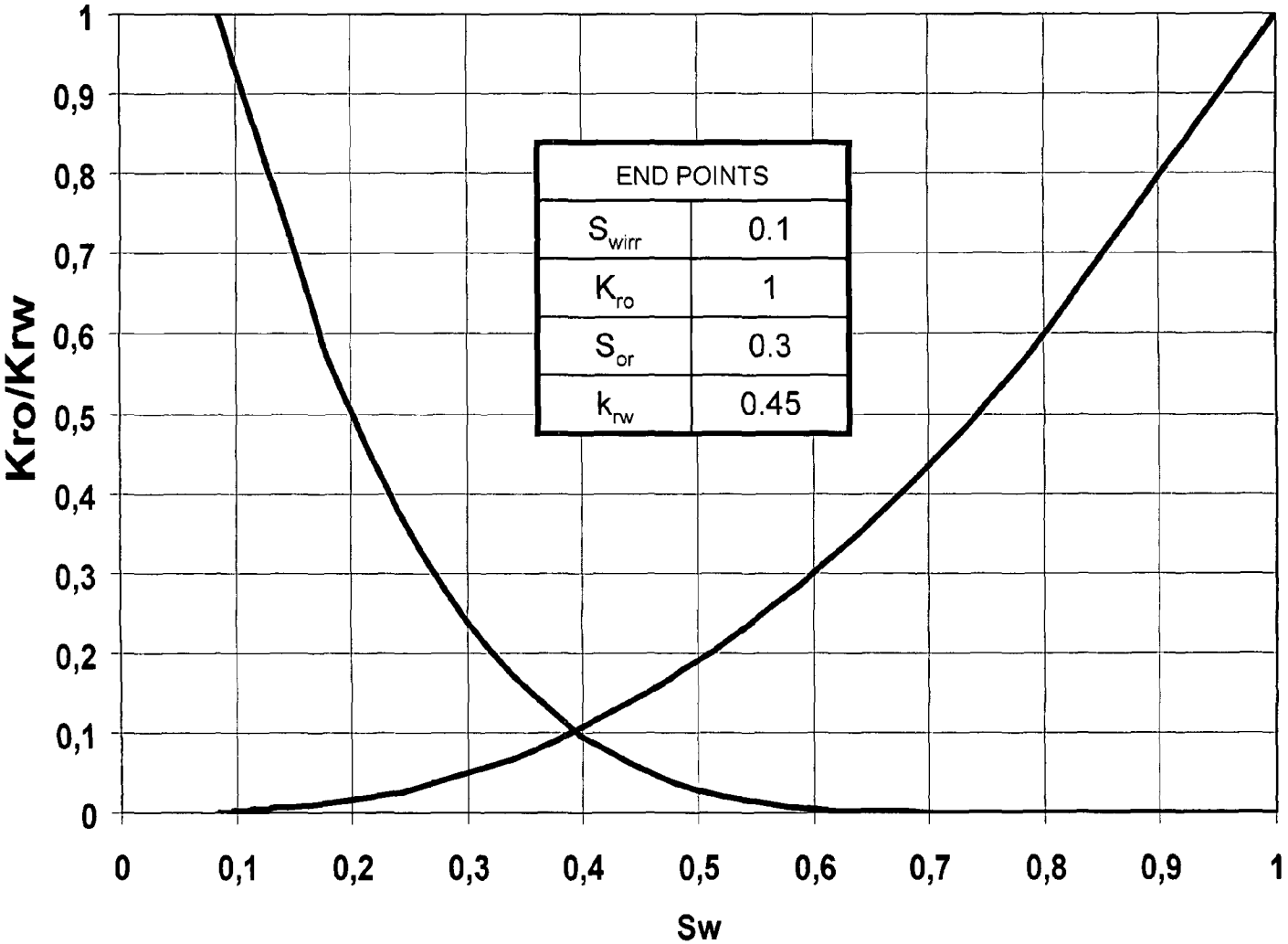
FIG. 3 is a plot used in establishing a set of relative permeability curves on the basis of core data.

To evaluate the bi-phase Skin (S*) and real Skin (S) the following procedure was adopted:

Using the known input data, the injection of the water flow-rates corresponding to the test effected, was simulated with a numerical well testing model. In particular a set of relative permeability curves was established on the basis of core data (FIG. 3) and an initial water saturation in the reservoir equal to $S_{wi}$=0.1. The real skin was set at S=O.

The pressure data generated by the numerical simulator were analyzed using conventional well testing analytical models. The skin value obtained proved to be different from zero. This skin was called bi-phase skin (S*).

In order to calculate the real skin (S), the total fall-off (St) and bi-phase skin (S*) being known, the following formula was used:

$$S=(S_{tot}-S^*)M$$

The mobility ratio M=0.24 was calculated on the basis of the viscosity and relative permeability values of the injection and reservoir fluids.

The following table (Table 2) indicates the results of the calculation effected:

TABLE 2

| Total Skin, bi-phase and real values SKIN VALUES (fall-off interpretation) | | |
|---|---|---|
| $S_t$ | $S^*_{numerical}$ | S |
| −3.30 | 11.5 | −3.55 |

Evaluation of the Productivity Index (PI)

The equation used for calculating the transient PI is the following (oilfield measurement unit):

$$PI_{transient} = \frac{kh}{162.6\mu_o B_o[\log(kt/\Phi\mu_o c_t r_w^2) - 3.23 + 0.87S]}$$

The PI was calculated at a time t corresponding to the duration of the conventional production test with which the analysis was confirmed.

The conventional production test PI was calculated by means of the formula:

$$PI_{transient}=Q/\Delta p$$

The results of the calculation of the productivity index are shown in the following table

TABLE 3

| Comparison of the calculated and measured PI | | |
|---|---|---|
| Pi measured from the production test | PI calculated from Fall-off | Difference |
| 6.20 | 6.46 | +4% |

The invention claimed is:

1. A process for testing hydrocarbon wells in order to obtain general information on a reservoir without necessity of producing surface hydrocarbons, comprising the following steps:

injecting into the reservoir a suitable liquid or gaseous fluid, compatible with the hydrocarbons of the reservoir and with the formation rock, at a constant flow-rate or with constant flow rate steps, and substantially measuring, in continuous, the flow-rate and injection pressure at the well bottom;

closing the well and measuring fall-off data including pressure during the fall-off period;

interpreting the measured fall-off data in order to evaluate a reference pressure of fluids in the reservoir (Pav) and the reservoir properties: actual permeability (k), transmissivity (kh), areal heterogeneity or permeability barriers and real Skin factor (S), wherein the real Skin factor (S) is obtained from a total Skin factor ($S_t$) reduced by a bi-phase Skin factor (S*) due to an interaction of the fluids in the reservoir; and calculating the well productivity.

2. The process-according to claim 1, wherein the injection fluid is a liquid selected from water or a hydrocarbon compound.

3. The process according to claim 1, wherein the real Skin factor (S) is obtained from a first stabilization of a conventional well testing.

4. The process-according to claim 1, wherein the measuring the fall-off data includes measuring temperature during the fall-off period.

5. The process according to claim 1, wherein the injecting and subsequent measuring of the fall-off data last for a time ranging from 1 hour to 4 days.

6. The process according to claim 5, wherein the injecting and subsequent measuring of the fall-off data last for a time ranging from 1 to 2 days.

* * * * *